US007121881B2

(12) United States Patent
Jones

(10) Patent No.: US 7,121,881 B2
(45) Date of Patent: Oct. 17, 2006

(54) METHOD AND APPARATUS FOR RF COAXIAL CONNECTIONS

(75) Inventor: Adam Jones, Windham, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/319,587

(22) Filed: Dec. 16, 2002

(65) Prior Publication Data

US 2004/0114995 A1 Jun. 17, 2004

(51) Int. Cl.
*H01R 13/60* (2006.01)

(52) U.S. Cl. ..... 439/578; 439/271; 439/429; 439/581; 439/583

(58) Field of Classification Search ..... 403/185, 403/286, 292, 293, 294, 296, 298; 439/271, 439/429, 578, 581, 583; 174/88 C, 71 C, 174/74 R, 75 R, 75 C
See application file for complete search history.

(56) References Cited

U.S. PATENT DOCUMENTS

| | | | | | |
|---|---|---|---|---|---|
| 3,291,895 | A | * | 12/1966 | Van Dyke | 439/578 |
| 3,350,500 | A | * | 10/1967 | Ziegler, Jr. | 439/271 |
| 3,453,376 | A | * | 7/1969 | Ziegler, Jr. et al. | 439/429 |
| 3,624,679 | A | * | 11/1971 | Ziegler, Jr. | 174/88 C |
| 3,778,535 | A | * | 12/1973 | Forney, Jr. | 439/320 |
| 4,046,451 | A | * | 9/1977 | Juds et al. | 439/429 |
| 4,585,289 | A | * | 4/1986 | Bocher | 439/581 |
| 5,435,745 | A | | 7/1995 | Booth | |
| 5,518,420 | A | * | 5/1996 | Pitschi | 439/578 |
| 5,795,188 | A | * | 8/1998 | Harwath | 439/583 |
| 6,133,532 | A | * | 10/2000 | Lundback et al. | 439/578 |

* cited by examiner

*Primary Examiner*—Daniel P. Stodola
*Assistant Examiner*—Victor MacArthur
(74) *Attorney, Agent, or Firm*—Baker & Hostetler LLP

(57) ABSTRACT

A connector for connecting high-power RF coaxial joints uses a screw-thread locking ring to draw a body and a bushing of the joint together. The connector also includes an O-ring seal.

10 Claims, 3 Drawing Sheets

METHOD AND APPARATUS FOR RF COAXIAL CONNECTIONS

FIELD OF THE INVENTION

The present invention relates generally to radio-frequency (RF) electromagnetic transmission equipment. More particularly, the present invention relates to an apparatus and method for coupling high-power RF coaxial lines to each other and/or to other functional units.

BACKGROUND OF THE INVENTION

High-voltage, high-power RF signals, as employed for example in the field of broadcasting for communication and entertainment, are often coupled from transmitters, which are typically located at ground level or otherwise made readily accessible for maintenance, for distances up to thousands of feet to reach the antennas from which the signals radiate.

This coupling process usually takes place using rigid coaxial lines (coax) made from concentric pieces of tubing, spaced with insulators, carefully dimensioned and finished, assembled, sealed, and often pressurized, typically with aggressively dried air or with nitrogen gas that has been purged of water vapor, oxygen, and other contaminants to the greatest extent possible. Individual sections of coax, which may be from an inch or less up to a foot in diameter depending on the level of power carried, are typically joined end to end to each other and/or to other equipment using specialized connectors or couplings.

Where space is not at a premium, it is often possible to use the standard fittings that were developed and adopted by the Electronics Industry Association (EIA) as EIA-225 some decades ago. These fittings are generally standardized and interchangeable. However, for some applications, space can be critical, and for such circumstances the known fittings can be undesirably bulky. For example, some prior art devices employ radially projecting flanges joined by longitudinal bolts. The radial projection dimension can be significant, due to clearance for bolt heads and tool heads that drive the bolts. In the prior art, there is no suitable reduced-dimension substitute among EIA-225 standard RF power fittings.

Accordingly, there is a need in the art for an RF power coaxial coupling outer fitting that provides the capability for reduced size, reduced element spacing, and/or increased packing density when compared to conventional designs, while retaining RF performance that is essentially identical to conventional designs and mechanical strength that achieves a level of performance suitable for useful applications.

SUMMARY OF THE INVENTION

Preferred embodiments of the invention provide an RF power coaxial coupling outer fitting with the capability for reduced size, reduced element spacing, and/or increased packing density when compared to conventional designs, while retaining adequate mechanical strength and RF performance that is essentially identical to conventional designs.

In a first aspect, a connector for connecting a first coaxial part to a second coaxial part comprises a generally cylindrical body connected to the first coaxial part; a generally cylindrical bushing connected to the second coaxial part and insertable into the conductive body; and a releasable locking ring that engages with the body and urges the body into contact with the bushing.

In another aspect, a connector for connecting a first coaxial part to a second coaxial part comprises first conducting means connected to the first coaxial part; a second conducting means connected to the second coaxial part and insertable into the first conducting means; and means for urging the second conductive means into contact with the first conductive means.

In yet another aspect, a method for connecting a first coaxial part to a second coaxial part comprises the steps of connecting a generally cylindrical body to the first coaxial part; connecting a generally cylindrical bushing to the second coaxial part; inserting the bushing into the body; and urging the body into contact with the bushing so that the bushing has mating contact with the body.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the invention provides an RF power coaxial coupling outer fitting with the capability for reduced size, reduced element spacing, and/or increased packing density when compared to conventional designs, while retaining adequate mechanical strength and RF performance that is essentially identical to conventional designs. An embodiment preferably employs a single, circumferentially threaded outer coupling mating to a circumferentially threaded locking ring to urge together the ends of two coaxial parts, such as for example two segments of high-power, rigid coaxial line. This arrangement can provide a reduced outer diameter compared to present connector arrangements.

Figure 1:
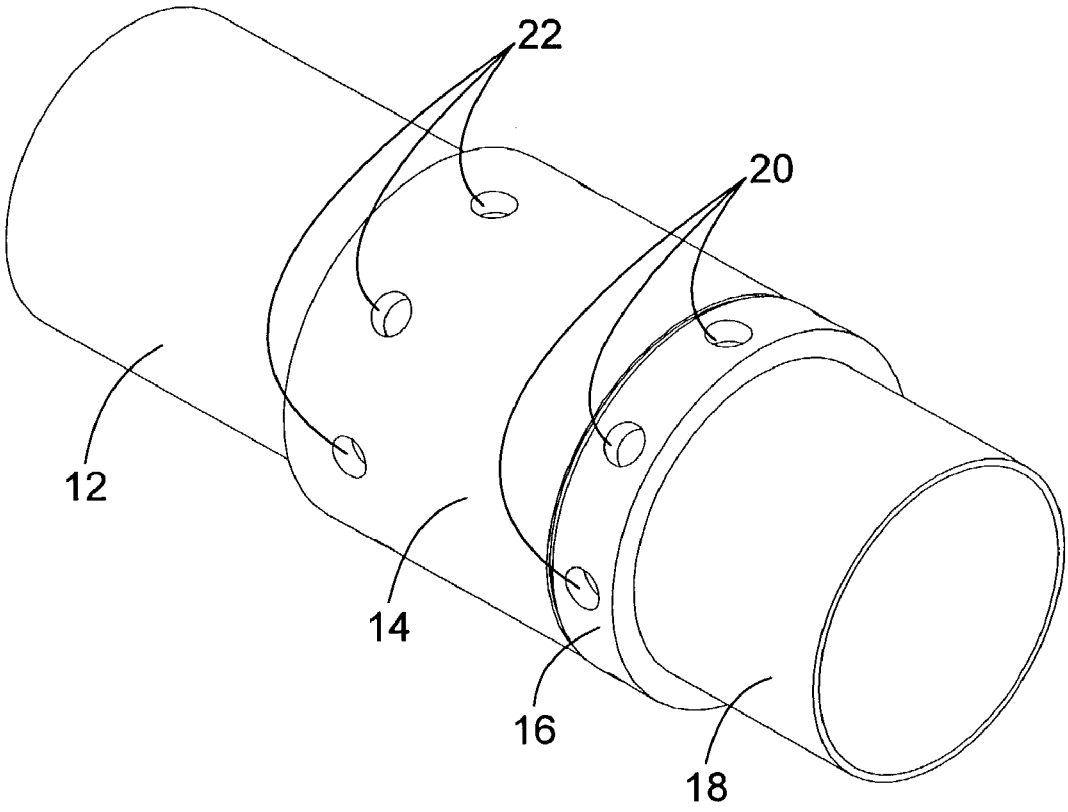
FIG. 1 is a perspective view illustrating an RF connector that incorporates a reduced-diameter connector arrangement according to a preferred embodiment of the present invention.

FIG. 1 illustrates a connector 10 for connecting a typical piece of outer coax 12 to a second piece of outer coax 18. The first coax 12 is conductively and preferably permanently bonded to a threaded outer conductive body 14. A mating threaded locking ring 16 screws into the body 14, drawing the ring 16 towards the body 14 and urging into position a conductive bushing element, which is hidden in FIG. 1. The conductive bushing is conductively and preferably permanently bonded to the second coax 18. The ability to apply torque to the locking ring 16 may be increased by the use of a conventional pin spanner type wrench, not shown, using a first hole pattern 20 to couple the spanner to the locking ring 16. In the preferred embodiment shown, a second hole pattern 22 on the body 14 can provide purchase for a second pin spanner, not shown, use of which can in turn permit the force application to be confined to the outer conductive body 14 and not transferred to the proximal solder joints of other assembled joints, the structure to which the coax is attached, and the like.

Besides connecting a coax 12 to a coax 18, the connector 10 can connect a coax 12 to an item such as a signal box having a coax fitting.

A benefit of the preferred embodiment is its provision for possible reduction in the overall diameter of the joint compared to prior art connectors. For example, for a 4 1/16 inch outer diameter coax the overall flange diameter is less than 5 inches for the preferred embodiment compared to 6 3/16 inches in the prior art connectors. The prior art requires the larger diameter to accommodate the radial flanges provided for bolt head and tool clearance.

Figure 2:
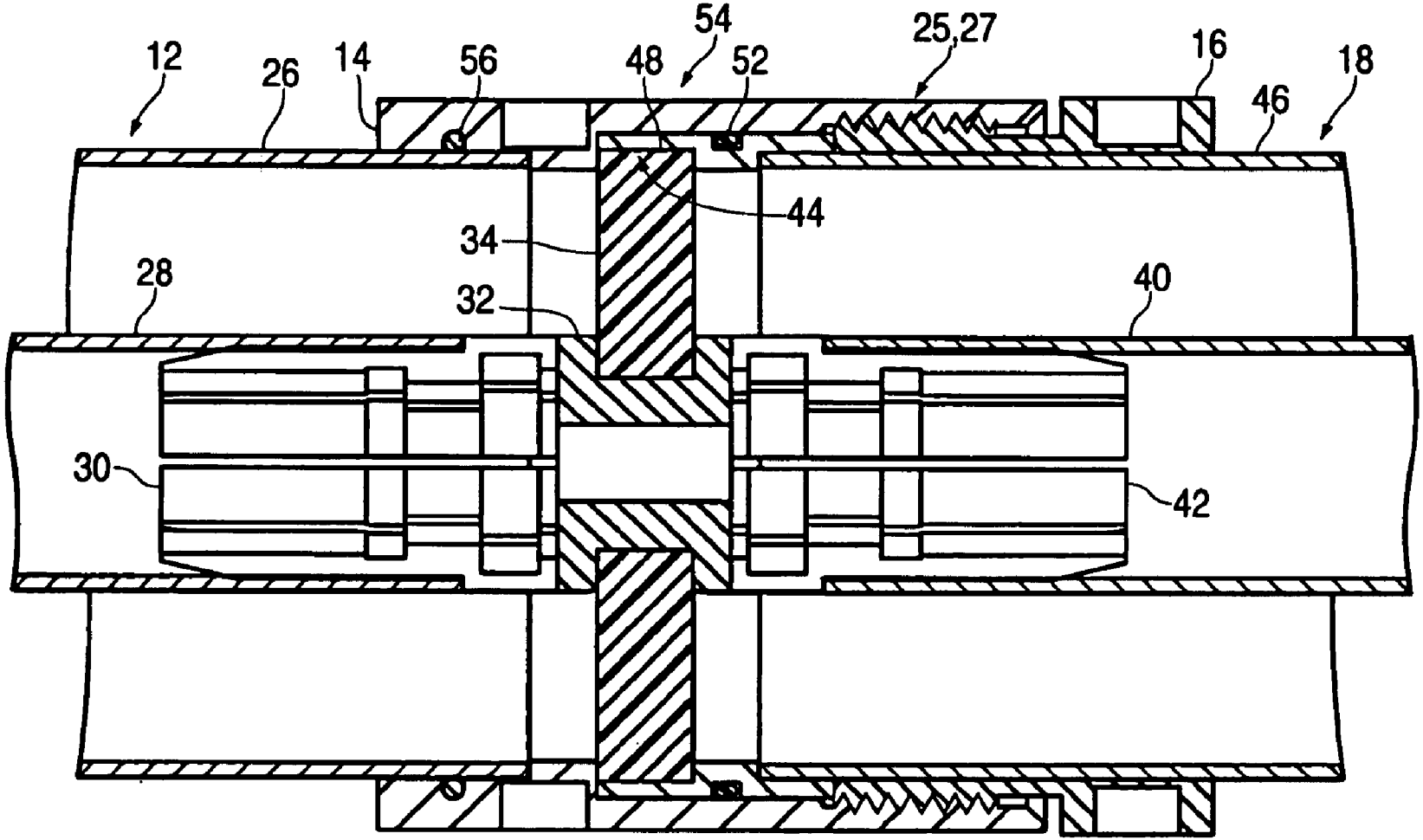
FIG. 2 is a longitudinal section view through the center of the connector of FIG. 1.

FIG. 2 is a section view of the connector of FIG. 1, showing the threaded locking ring 16 having a threaded region 25 that engages a threaded region 27 inside body 14.

A first coaxial part such as for example the coax 12 has an outer conductor 26 and a center conductor 28. The center conductor 28 can be terminated by pressing it onto a first side 30 of a double male center conductor union 32 of conventional design, which union 32 can include a permanently attached insulating spacer 34. The outer conductor 26 of the coax 12 terminates by being bonded to the first outer conductive body 14 in accordance with the preferred embodiment.

A second coaxial part such as for example a second coax 18, has an inner conductor 40 here shown fitted onto the second side 42 of the exemplary double male center conductor union 32. The insulating spacer 34 of the exemplary union 32 is trapped between the two outer conductive fittings in a cutout 44 provided for that purpose. The second coax 18 has a second coax outer conductor 46 to which a mating second outer conductive bushing 48 is conductively and preferably permanently bonded in accordance with a preferred embodiment.

A threaded locking ring 16 urges the outer conductive body 14 and conductive bushing 48 into intimate contact when screwed tight, as by using the spanners referred to above. A resilient O-ring 52 seated in an O-ring groove 54 may provide a seal with negligible gas leakage when assembled as shown in FIG. 2.

Figure 3:
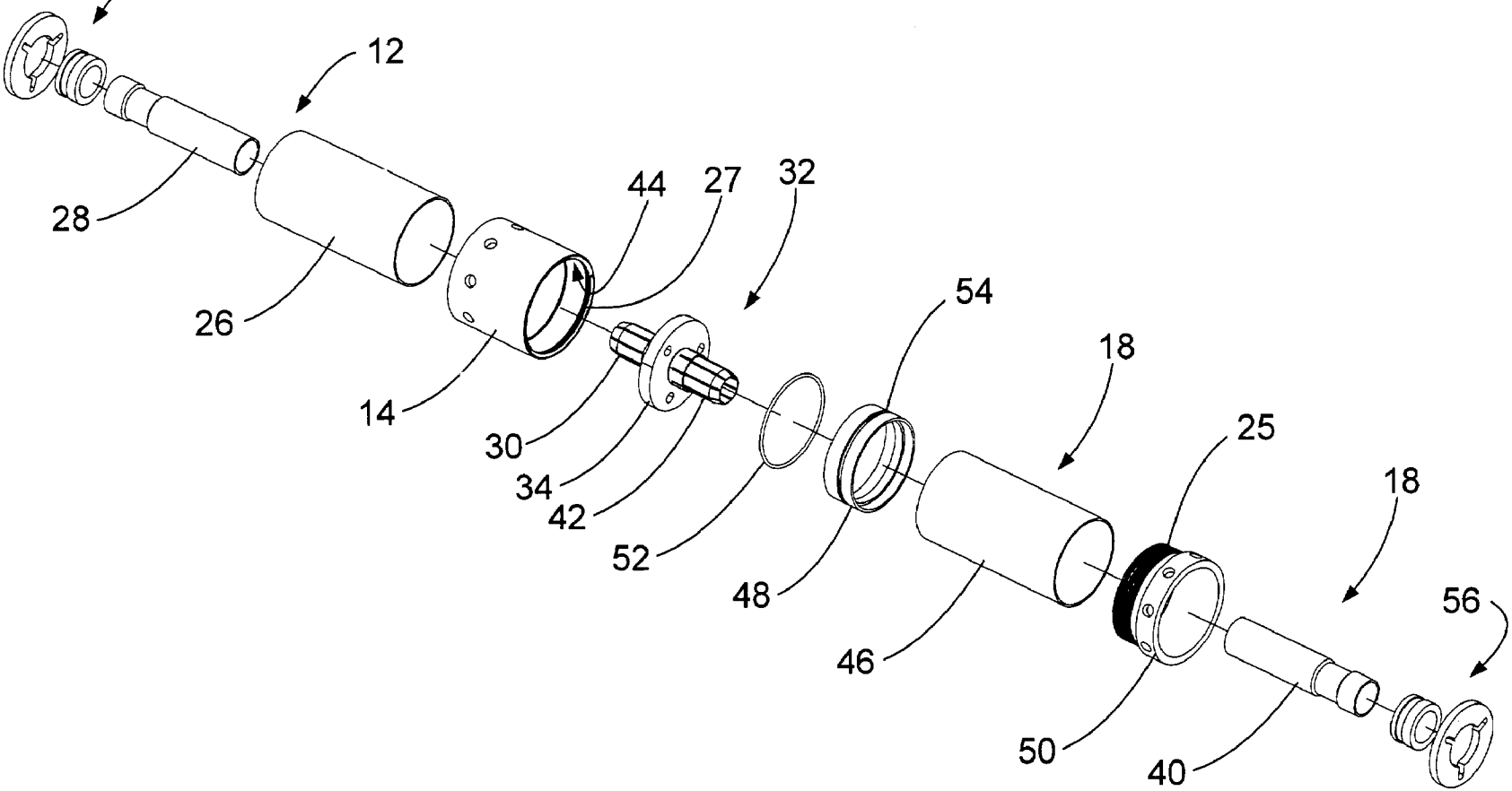
FIG. 3 is an exploded oblique view of the connector of FIG. 1.

FIG. 3 is an exploded diagram of the connector of FIG. 1. The O-ring 52 can be properly seated to ensure easy assembly and an air tight seal, and to avoid damage that could allow leakage after extended service. Use of a lubricant, not shown, compatible with the housing and O-ring materials, may be beneficial for many applications, as it reduces assembly friction, fills microscopic gaps even in the presence of the requisite slight overpressure of a complete system, and is largely inert after assembly.

FIG. 3 shows representative additional center conductor spacer assemblies 56 to illustrate a method by which uniformity of spacing, and thus uniformity of characteristic impedance, of a coaxial line that could employ the preferred embodiment can be maintained throughout segments that are typically on the order of twelve feet in length. Distance between spacers can be determined according to the mechanical properties of the inner and outer conductors, and can be maximized with the aim of establishing a dielectric constant for the coax that is as close as possible to that of free air, traded off against structural robustness. Alternative spacer designs, including such approaches as the use of nonconductive pins instead of disks of the style shown or a variety of other styles, can be employed.

The preferred embodiment provides a reduced-footprint outer coupler for high-power coax, and presents the use of the same inner-conductor coupler 32 and insulating spacer 34 as used in previous outer coupler designs, including EIA-225 compatible outer couplers. Thus, while using an off-the-shelf inner coupler 32 and insulating spacer 34, an installation according to the preferred embodiment can benefit from the reduced need for external clearance that can be afforded by the present invention.

Since the preferred embodiment can have the same insulating spacer cutout 44 (in the bushing 48) as previous outer coupler designs, any inner coupler and spacer design that improves on standard inner coupler designs but is intended to work with conventional outer couplers can be substituted for standard-design inner couplers in a system incorporating the preferred embodiment. This can allow a product or system that demands the reduced external size afforded by the present invention to benefit from future inner coupler design improvements as well.

Typical rigid coax sections 12 and 18 intended for continuous outdoor exposure are made from electroless copper or another high-conductivity material. Outer conductor connector components 14, 16 and 48 for such applications are preferably made from materials such as phosphor bronze that combine acceptable conductivity with mechanical strength and immunity to weather, pollution, structural stresses, and other hazards. It is preferable to select any dissimilar conductive materials that must be in contact so that their electronegativities are within 0.25 (on the unitless Pauling scale) of each other to prevent erosion by electrolytic effects. Another often preferable attribute in all broadcast transmission line applications of this general type is gas flow minimization through sealing and maintenance of a low overpressure in the interior of the system to keep the electrical components that conduct or insulate RF signals free of contaminants. If the outside of the system is weatherproofed by coating components such as 14, 16 with durable, nonconductive finishes, and if the constituent parts other than those in the actual RF signal propagation path-namely, the tower and guy structure, brackets, hangers, supports, and the like-are insulated from one another to the extent feasible, then the risks to long-term, maintenance-free operation are reduced.

Assembly of systems employing conventional EIA-225 flange couplings and couplings according to the preferred embodiment of the present invention commonly involves prefabricating individual sections of inner and outer coax with spacers 32 and with the bushing 48 and body 14 already bonded in place on the respective ends of coaxes 12, 18, and with the locking ring 16 slid over the coaxes, in a manufacturing facility. These prefabricated sections may then be lifted into place and assembled in the case of the present invention, by holding the outer conductive body 14 with one spanner and urging the components into their final configuration by rotating the threaded locking ring 16 with a second spanner. According, the preferred embodiment is advantageous for locations in close proximity to antennas, as well as other locations where space is at a premium.

Several attachment methods to permanently affix the body 14 and bushing 48 to the coax ends are available, with the materials and methods of assembly depending on, among other issues, the materials from which the components 14 and 48 and the coax outer conductors 26, 46 are made. Welding, brazing, and soldering are commonly useful and reliable methods for bonding elements that may be substantially permanently assembled, while friction-based attachment methods can also be employed. The design of the body 36 in the preferred embodiment facilitates soldering onto the end of a coax outer conductor 26 by the provision of a slot 58 into which a solder preform may be fitted prior to assembly. Subsequent application to the joint area of the assembly of controlled heat sufficient to flow the solder can yield a permanent, gas-tight joint. Such an attachment method (slot and solder preform), also usable in attaching the bushing 48 to the second coax outer conductor 46, is not illustrated in the drawings. Alternate methods such as applying solder-and-flux paste to chemically cleaned elements before applying heat likewise produce satisfactory joints.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A connector for connecting a first non-corrugated coaxial part to a second non-corrugated coaxial part, comprising:

a generally cylindrical body having an inner surface, wherein a first end of said inner surface of said generally cylindrical body is unremovably connected to the first non-corrugated coaxial part, and wherein a second end of said inner surface of said generally cylindrical body has internal threads;

a generally cylindrical bushing having an outer diameter larger than the first and second coaxial parts, wherein said generally cylindrical bushing is contacting the second coaxial part, and wherein said generally cylindrical bushing is sealable to and insertable into said generally cylindrical body; and a releasable locking ring having an inner surface and an outer surface, wherein said inner surface of said ring rotates freely about the second coaxial part, wherein an end of said outer surface of said ring proximal to said bushing has external threads mateable to said internal threads of said body, and wherein, when said ring is rotated in a direction to advance said threads, an interior edge of said body is urged into contact with said bushing to form a seal.

2. The connector of claim 1, wherein at least said body and said bushing are conductive material.

3. The connector of claim 1, wherein both of the first and second non-corrugated coaxial parts are substantially rigid tubular coaxial lines.

4. The connector of claim 1, wherein said bushing has a first end distal to the first non-corrugated coaxial part, and wherein said end of said locking ring proximal to said bushing bears against said first end to urge said bushing against said body when said locking ring is tightened.

5. The connector of claim 1, wherein said locking ring has a first feature incorporated therein to permit application of torque by a tool.

6. The connector of claim 5, wherein said first feature is a hole pattern.

7. The connector of claim 1, wherein said body has a second feature incorporated therein to permit application of torque by a tool.

8. The connector of claim 1, wherein said bushing has a circumferential outer groove and said connector further comprises a sealing O-ring disposed in said circumferential groove.

9. The connector of claim 1, wherein said body has an inner surface with a first relieved region to form a first bond material reservoir to facilitate bonding said body to the first non-corrugated coaxial part.

10. The connector of claim 1, wherein said bushing has an inner surface with a second relieved region to form a second bond material reservoir to facilitate bonding said bushing to the second non-corrugated coaxial part.

* * * * *